US007303464B1

(12) United States Patent
Orf

(10) Patent No.: US 7,303,464 B1
(45) Date of Patent: Dec. 4, 2007

(54) CONTACT WHEEL

(75) Inventor: Nicholas A. Orf, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/549,426

(22) Filed: Oct. 13, 2006

(51) Int. Cl.
*B24B 1/00* (2006.01)

(52) U.S. Cl. ..... 451/49; 451/355; 451/490

(58) Field of Classification Search ..... 451/49, 451/355, 490, 491, 168, 540–551, 904
See application file for complete search history.

(56) References Cited

U.S. PATENT DOCUMENTS

| | | | | |
|---|---|---|---|---|
| 2,257,864 | A | | 10/1941 | Sheehan |
| 2,378,643 | A | | 6/1945 | Losey |
| 2,527,554 | A | | 10/1950 | Kimball |
| 2,530,960 | A | | 11/1950 | Hall |
| 2,578,662 | A | | 12/1951 | Bader |
| 2,639,560 | A | | 5/1953 | Cosmos |
| 2,701,431 | A | | 2/1955 | Whitesell |
| 2,778,166 | A | | 1/1957 | Cosmos |
| 2,806,379 | A | | 9/1957 | Haracz |
| 2,850,853 | A | | 9/1958 | Simendinger |
| 3,000,149 | A | | 9/1961 | Johnson |
| 3,083,584 | A | | 4/1963 | Nanson |
| 3,273,288 | A | | 9/1966 | Kuris et al. |
| 4,910,924 | A | * | 3/1990 | Bouchard et al. ..... 451/548 |
| 5,085,010 | A | | 2/1992 | Grau |
| 5,152,917 | A | | 10/1992 | Pieper et al. |
| 5,313,742 | A | * | 5/1994 | Corcoran et al. ..... 451/541 |
| 5,339,570 | A | * | 8/1994 | Amundson et al. ..... 451/490 |
| 5,593,345 | A | | 1/1997 | Johnson |
| 6,645,060 | B2 | | 11/2003 | Luedeke |
| 2003/0017788 | A1 | * | 1/2003 | Hagiwara ..... 451/44 |

OTHER PUBLICATIONS

ASTM D2240-05, Standard Test Method for Rubber Property—Durometer Hardness, 2005.

* cited by examiner

*Primary Examiner*—Dung Van Nguyen

(57) ABSTRACT

A composite contact wheel, grinding assemblies comprising the same, and methods of abrading cylindrical workpieces using coated abrasive belts.

25 Claims, 3 Drawing Sheets

| 3M™ Trizact Diamond Cloth Belt 663FC (70 micron) Recommended Roll Grinding Operating Parameters | | | | | |
|---|---|---|---|---|---|
| Abrasive | 3M ™ Trizact™ Diamond Cloth Belt 663FC | | | | |
| Belt Width | 2 inches (wider belts allow faster traverse) | | | | |
| Belt Speed | 6,000 SFPM | | | | |
| End of Roll Dwell | 1/2 overlap - 2 revolutions | | | | |
| | Shoulder grind - 5 revolutions | | | | |
| | | | Cubic Removal Rate (in^3/min) | | |
| | =75 SFPM | =0.25 Inch/rev | 0.18 | 0.27 | 0.37 |
| Rod Diameter | RPM | Traverse Rate | Infeed Per pass (on diameter) | | |
| (inches) | (Workpiece) | (Inch/min) | Tungsten Carbide | Chrome Carbide | Nickel Based |
| 1.50 | 191.0 | 47.7 | 0.0016 | 0.0024 | 0.0033 |
| 2.00 | 143.2 | 35.8 | 0.0016 | 0.0024 | 0.0033 |
| 2.50 | 114.6 | 28.6 | 0.0016 | 0.0024 | 0.0033 |
| 3.00 | 95.5 | 23.9 | 0.0016 | 0.0024 | 0.0033 |
| 3.50 | 81.9 | 20.5 | 0.0016 | 0.0024 | 0.0033 |
| 4.00 | 71.6 | 17.9 | 0.0016 | 0.0024 | 0.0033 |
| 4.50 | 63.7 | 15.9 | 0.0016 | 0.0024 | 0.0033 |
| 5.00 | 57.3 | 14.3 | 0.0016 | 0.0024 | 0.0033 |
| 5.50 | 52.1 | 13.0 | 0.0016 | 0.0024 | 0.0033 |
| 6.00 | 47.7 | 11.9 | 0.0016 | 0.0024 | 0.0033 |
| 6.50 | 44.1 | 11.0 | 0.0016 | 0.0024 | 0.0033 |
| 7.00 | 40.9 | 10.2 | 0.0016 | 0.0024 | 0.0033 |
| 7.50 | 38.2 | 9.5 | 0.0016 | 0.0024 | 0.0033 |
| 8.00 | 35.8 | 9.0 | 0.0016 | 0.0024 | 0.0033 |
| 8.50 | 33.7 | 8.4 | 0.0016 | 0.0024 | 0.0033 |
| 9.00 | 31.8 | 8.0 | 0.0016 | 0.0024 | 0.0033 |
| 9.50 | 30.2 | 7.5 | 0.0016 | 0.0024 | 0.0033 |
| 10.00 | 28.6 | 7.2 | 0.0016 | 0.0024 | 0.0033 |
| 10.50 | 27.3 | 6.8 | 0.0016 | 0.0024 | 0.0033 |
| 11.00 | 26.0 | 6.5 | 0.0016 | 0.0024 | 0.0033 |
| 11.50 | 24.9 | 6.2 | 0.0016 | 0.0024 | 0.0033 |
| 12.00 | 23.9 | 6.0 | 0.0016 | 0.0024 | 0.0033 |
| 12.50 | 22.9 | 5.7 | 0.0016 | 0.0024 | 0.0033 |
| 13.00 | 22.0 | 5.5 | 0.0016 | 0.0024 | 0.0033 |
| 13.50 | 21.2 | 5.3 | 0.0016 | 0.0024 | 0.0033 |
| 14.00 | 20.5 | 5.1 | 0.0016 | 0.0024 | 0.0033 |
| 14.50 | 19.8 | 4.9 | 0.0016 | 0.0024 | 0.0033 |
| 15.00 | 19.1 | 4.8 | 0.0016 | 0.0024 | 0.0033 |
| 20.00 | 14.3 | 3.6 | 0.0016 | 0.0024 | 0.0033 |
| 24.00 | 11.9 | 3.0 | 0.0016 | 0.0024 | 0.0033 |
| 30.00 | 9.5 | 2.4 | 0.0016 | 0.0024 | 0.0033 |
| 36.00 | 8.0 | 2.0 | 0.0016 | 0.0024 | 0.0033 |
| 48.00 | 6.0 | 1.5 | 0.0016 | 0.0024 | 0.0033 |
| 60.00 | 4.8 | 1.2 | 0.0016 | 0.0024 | 0.0033 |

*Fig. 4*

CONTACT WHEEL

FIELD

The present disclosure relates generally to a contact wheel and methods of making and using the same. More particularly, the present disclosure relates to a composite contact wheel and an abrasive grinding assembly comprising such contact wheel.

BACKGROUND

Grinding and polishing of cylindrical surfaces (e.g., roll grinding, centerless grinding) has traditionally been accomplished by using vitrified or resin bonded grinding wheels mounted on a centered or centerless grinding machine. The use of bonded grinding wheels for cylindrical grinding requires constant attention to the grinding process, including maintenance of the wheel surface in order to maintain consistent grinding performance and to true the grinding surface to the cylindrical workpiece.

Coated abrasive belts provide an alternative to bonded wheel grinding system. Such coated abrasive belts are typically supported by a contact wheel. Contact wheels typically consist of a metallic hub and a circumferential coating of an elastomer (e.g., rubber or polyurethane). When bonded wheel grinding systems are retrofitted to accept abrasive belts, the contact wheel is frequently used to both drive the abrasive belt and to urge the coated abrasive belt surface against the workpiece. While the elastomeric coating provides increased friction (compared to metal), such coatings result in less precise control of the interference of the abrasive belt to the cylindrical workpiece surface, which compromises dimensioning tolerances. Metal contact wheels generally provide more precise control than elastomeric coated contact wheels but can be difficult to dress (i.e., true). Metal contact wheels are also known to create unwanted vibration and harmonics during the grinding process.

There is a continuing need for new contact wheels with improved operating performance, as well as methods for using the same.

SUMMARY

The present disclosure relates generally to a contact wheel and methods of making and using the same. More particularly, the present disclosure relates to a composite contact wheel and an abrasive grinding assembly comprising such contact wheel.

In one aspect, the present disclosure provides a composite contact wheel for supporting an abrasive belt. The composite contact wheel has a first side, a second side opposite the first side, and a cylindrical peripheral surface extending between the first side and the second side. The composite contact wheel has a first composition comprising at least 10 (in some embodiments, at least 20, 30, or even at least 40) percent by weight polymer and at least 20 (in some embodiments, at least 25, 30, or even at least 35) percent by weight reinforcing fiber. The cylindrical peripheral surface of the composite contact wheel has substantially uniform hardness of at least 50 (in some embodiments, at least 60, 70, 80, or even at least 90) Shore D.

In some embodiments, the composite contact wheel comprises phenol-formaldehyde and/or glass fibers. In some embodiments, the composite contact wheel has a substantially homogeneous composition.

In another aspect, the composite contact wheel can comprise an annular rim and a hub, wherein the annular rim comprises the cylindrical peripheral surface and the first composition, and the hub comprises a second composition.

In another aspect, the composite contact wheel can have an abrasive element affixed to at least one side of the composite contact wheel.

The present disclosure also provides grinding assemblies utilizing the composite contact wheel of the present disclosure as well as methods for grinding cylindrical workpieces.

In the context of the present disclosure:

"substantially uniform hardness" refers to a surface with homogeneous hardness that does not vary by more than 20 (in some embodiments, 15, 10, or even less than 5) percent as measured using ASTM D 2240-05. The cylindrical peripheral surface of a bonded grinding wheel does not have a substantially uniform hardness because it has hard regions (i.e., abrasive particles) and soft regions (i.e., glass or resin binder).

"substantially homogeneous composition" refers to a composition with constituents having concentrations that do not vary by more than 10 percent by weight from one region to another as measured over a 1 $cm^3$ volume.

The above summary of the present invention is not intended to describe each disclosed embodiment of every implementation of the present invention. The Figures and the detailed description that follow more particularly exemplify illustrative embodiments. The recitation of numerical ranges by endpoints includes all numbers subsumed with that range and insubstantial variations normal to the manufacturing process (e.g., 1 to 5 includes 1, 1.5, 2, 2.75, 3, 4, 4.80, and 5).

BRIEF DESCRIPTION OF THE DRAWING

FIG. 4 is a chart of recommended roll grinding operating parameters for 3M TRIZACT DIAMOND CLOTH BELT 663FC.

Figure 1:
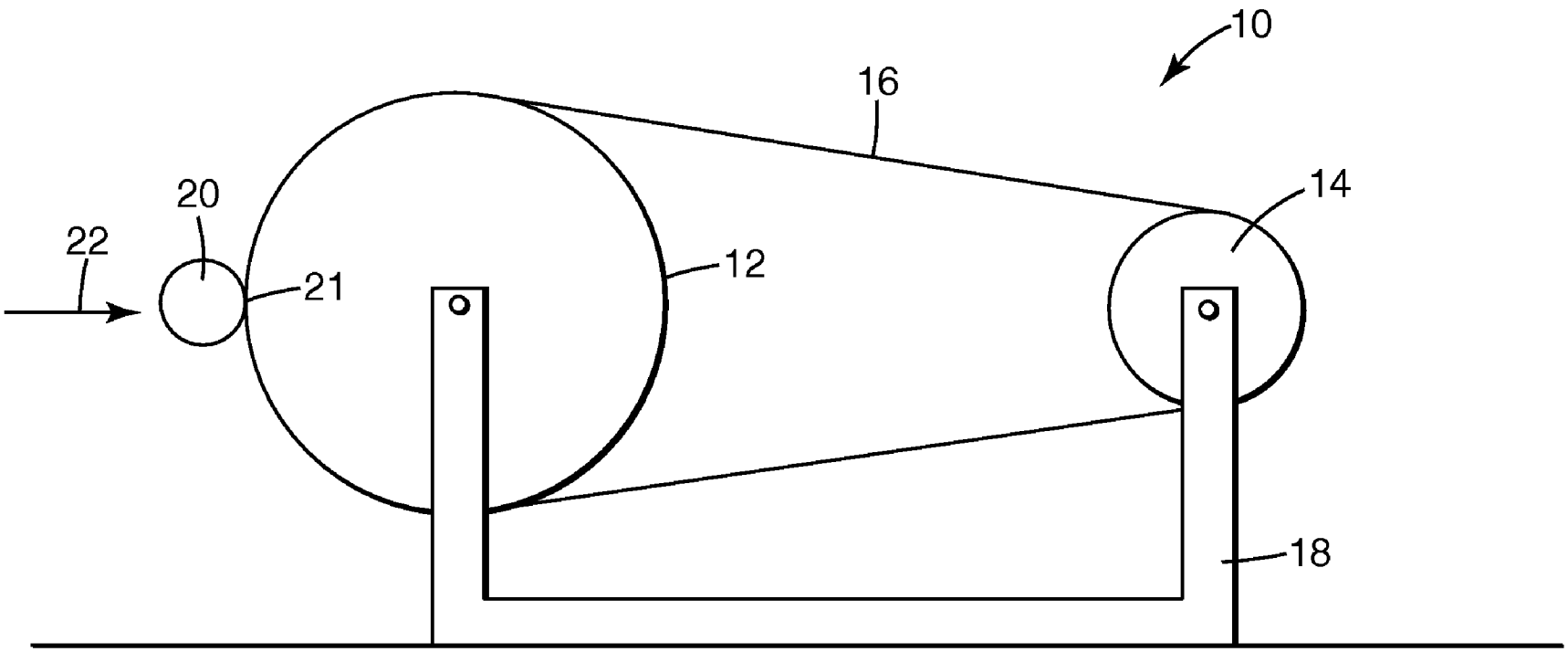
FIG. 1 is a schematic representation of a grinding assembly that includes a contact wheel and a workpiece to be abraded.

While the above-identified drawing figures set forth several exemplary embodiments of the disclosure, other embodiments are also contemplated. This disclosure presents illustrative embodiments of the present invention by way of representation and not limitation. Numerous other modifications and embodiments can be devised by those skilled in the art which fall within the scope and spirit of the principles of the present disclosure. The drawing figures are not drawn to scale.

DETAILED DESCRIPTION

FIG. 1 is a schematic representation of an exemplary grinding assembly 10 that utilizes a contact wheel of the present disclosure. As shown in FIG. 1, grinding assembly 10 includes a contact wheel 12 and idler wheel 14 that support an endless abrasive belt 16. Contact wheel 12 and idler wheel 14 are supported and spaced by frame assembly 18. During operation, workpiece 20 is pushed in direction 22 against rotating abrasive belt 16 to abrade workpiece 20. The contact wheel 12 supports the abrasive belt 16 at the abrading interface 21. The grinding assembly of FIG. 1 is intended to be an exemplary representation of grinding assemblies that the contact wheels of the present disclosure can be used with. One skilled in the art will understand that the grinding assembly will typically include at least one motor, abrasive belt tensioners, belt tracking devices, and other features not shown in FIG. 1, but known within the art.

Contact wheels of the present disclosure can be used with commercially available grinding assemblies known to those skilled in the art, including, for example bonded wheel grinding machines, such as those commercially available from Landis Grinding Systems (Waynesboro, Pa.) and Cincinnati Machine (now owned by Landis-Gardner, Waynesboro, Pa.), that have been converted to accept abrasive belts and their concomitant contact wheels. Such conversions are provided, for example, by Abbott Machine Co. (Alton, Ill.). The composite contact wheels of the present disclosure can also be used with lathes with belt attachments, such as available from G&P Industries (Indianapolis, Ind.) and have been sold by Finishers Technology in the past.

Figure 2:
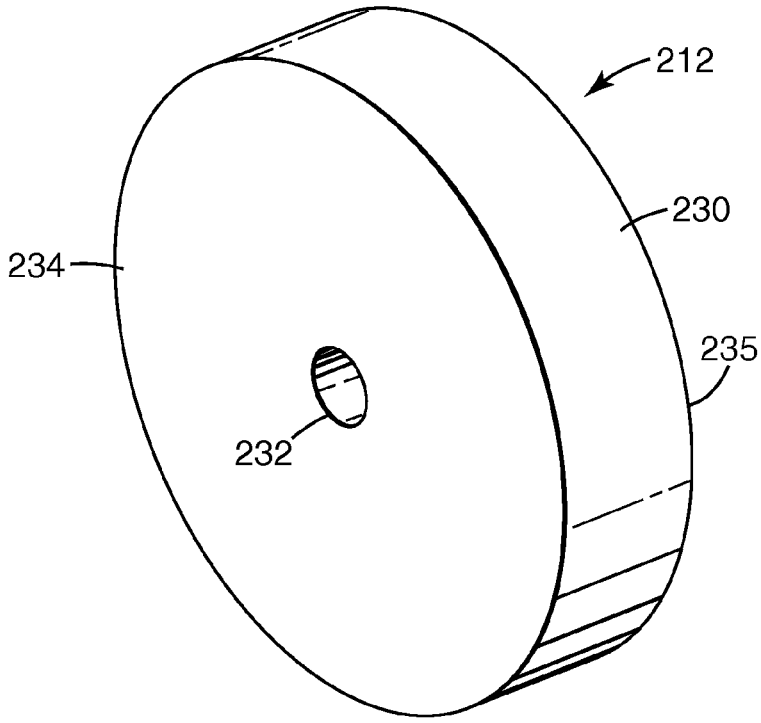
FIG. 2 is a perspective view of an exemplary contact wheel of the present disclosure having a unitary construction.

FIG. 2 is a perspective view of an exemplary contact wheel of the present disclosure having a unitary construction. In the context of the present disclosure, a contact wheel with "unitary construction" refers to a contact wheel having a single component, as opposed to a wheel made from multiple components. As shown in FIG. 2, contact wheel 212 is a cylindrical body having a first sidewall 234, a second sidewall 235, a cylindrical peripheral surface 230 extending between first sidewall 234 and second sidewall 235, and a mount 232. Mount 232 is configured for mounting the contact wheel to a grinding assembly. As shown in FIG. 2, the mount typically comprises a center through-hole for mounting on a shaft or arbor. In some embodiments, the mount may comprise mounting holes provided in a bolt circle concentric with the axis of rotation of the composite contact wheel to accept one or more mounting flanges.

The composite contact wheel of the present disclosure comprises a polymer and a reinforcing fiber. In the context of the present disclosure, "fiber" refers to an elongated material having an aspect ratio of at least 20 to 1 (in some embodiments, 50:1 or even 100:1). Such compositions provide the beneficial properties associated with the composite contact wheel of the present disclosure, such as incompressibility, dimensional stability, and the ability to damp vibrations emanating from both the grinding machine and the grinding process itself. Other added benefits include that the composite contact wheel of the present disclosure is easy to true to cylinder grinding machine, and that the composite contact wheel is low in cost to make and to use. In some embodiments, the composite contact wheel of the present disclosure when used with a coated abrasive belt, provides an operator with grinding characteristics comparable to a bonded wheel.

The polymer of the composite contact wheel may be thermoplastic or thermosetting. In one embodiment, the composite contact wheel consists of RESINOID 1328, available from Resinoid Engineering Corp. (Skokie, Ill.). In some embodiments, at least 10 (in some embodiments, at least 20, 30, or even 40) percent by weight of the composite contact wheel is a polymer component. The polymer selection should not compromise the ability of the composite to remain incompressible and dimensionally stable when subjected to end use conditions. When a thermoplastic polymer is employed, it should be selected to have a sufficiently high softening point in order to avoid deformation of the contact wheel under localized temperature and pressure extremes generated in the grinding operation. Suitable thermoplastic polymers include, for example, polyolefins, polyetheretherketons, polyetherimides, polyamides, polyimides, polyesters, and polyethersulfones. Thermosetting polymers are typically less prone to softening upon heating. Suitable thermosetting polymers include, for example, phenol-formaldehydes, melamine-formaldehydes, urea-formaldehydes, epoxies, acetals, cellulose acetate-butyrates, polyesters, and allyls.

Reinforcing fibers suitable for incorporation into the composite contact wheel are compatible with and readily incorporated into the polymer, and will generally increase stiffness, thermal stability, and mechanical stability, while not compromising the contact wheel's ability to damp vibrations. In some embodiments, at least 20 (in some embodiments, at least 25, 30, or even 35) percent by weight of the composite contact wheel is reinforcement fibers. Reinforcing fibers suitable for the contact wheel of the present disclosure may be organic or inorganic. Organic reinforcing fibers can help provide a lighter, less dense contact wheel, but may compromise thermal stability. Examples of suitable organic reinforcing fibers include chopped thermosetting or thermoplastic polymers. Examples of suitable inorganic reinforcing fibers include glass fibers, metallic fibers, ceramic fibers, and other such fibers known to those skilled in the art. Reinforcing fibers may include a coating of an interfacial agent (e.g., wetting agent) or coupling agent (e.g., silane or titanate) to increase the filler's effectiveness in the composite contact wheel.

Other additives may also be incorporated into the composite contact wheel. For example, lubricants (graphite, zinc stearate), antistatic agents (e.g., graphite, carbon black, metals), colorants, fillers, etc. may be incorporated into the composite contact wheel. Abrasive particles, such as, for example, diamond and aluminum oxide, should not be used near the cylindrical peripheral surface because their hardness can compromise the ability to easily dress the contact wheel and they can abrade the abrasive belt.

Composite contact wheels of the present disclosure can be made by molding processes. Contact wheel compositions comprising a thermoplastic polymer may be injection molded or thermoformed. Contact wheel compositions comprising a thermosetting polymer may be cast or compression molded. Alternatively, composite contact wheels may be made by machining operations from a suitably-dimensioned composite precursor.

In some embodiments, the cylindrical peripheral surface (the surface in contact with the abrasive belt) of the composite contact wheel is devoid of pattern or embossment. In some embodiments, the perimeter surface of the inventive composite contact wheel has projections and depressions inparted therein.

The composite contact wheel may be of any size as required by the cylinder grinding machine, the abrasive belt employed, and the workpiece to be processed. The composite contact wheel may have a central arbor hole provided to accept a mounting hub or driving shaft. A typical contact wheel may be 76 cm (30 inches) in diameter and 5 cm (2 inches) wide and have a center hole of 30 cm (12 inches) diameter.

Figure 3:
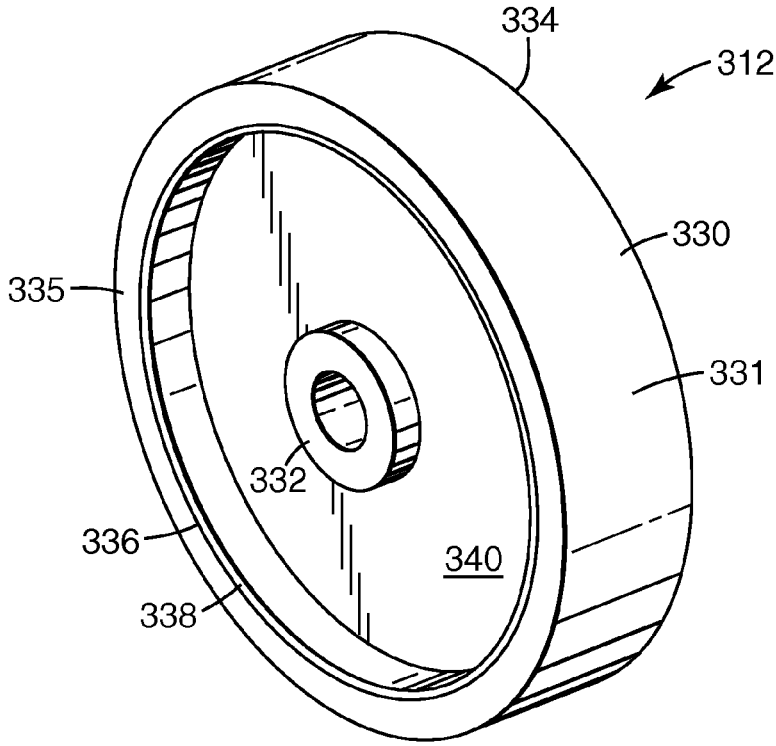
FIG. 3 is a perspective view of an exemplary contact wheel of the present disclosure having a two part construction.

In some embodiments, the composite contact wheel comprises an annular rim affixed to the periphery of a hub. FIG. 3 shows a perspective view of an exemplary contact wheel 312 of the present disclosure having a two part construction. As shown in FIG. 3, contact wheel 312 includes an annular rim 331 and a hub 340. The hub 340 has a rim 338 that forms interface 336 with annular rim 331. Annular rim 331 has a first side wall 334 a second side wall 335 opposite first side wall 334, and a cylindrical peripheral surface 330 that extends between first side wall 334 and second side wall 335. The hub 340 includes a mount 332 to affix composite contact wheel 312 to a grinding assembly.

The hub of a two part composite contact wheel can comprise any material known to those skilled in the art of contact wheels, including, for example, aluminum, steel, or ceramic. The annular rim may be molded directly onto the hub or can be separately manufactured and then combined. In some embodiments, the hub and the annular rim comprise the same composition.

The composite contact wheel of the present disclosure can be simply and rapidly trued to the workpiece surface. This can be accomplished by adhesively or otherwise affixing an abrasive sheet (abrasive side out) to the workpiece. The workpiece and the composite contact wheel (without the abrasive belt in place) are rotated and urged against each other. This results in the removal of any residual eccentricities of the composite contact wheel.

In some embodiments, the composite contact wheel may comprise an abrasive element having an abrasive surface on one or both sides. Typically, such abrasive elements are located on at least one side of the composite contact wheel and are at least proximal to the cylindrical peripheral surface of the composite contact wheel. Such abrasive elements afford a convenient means to grind or finish the end faces and/or terminal flange surfaces of cylindrical workpieces. In some embodiments, the abrasive elements are fabricated by adhering abrasive particles to at least one side of the composite contact wheel by using a suitable binder. Alternatively, the abrasive elements may comprise a lamination of separately-fabricated abrasive elements such as coated abrasives or bonded abrasives.

The composite contact wheel of the present disclosure can be used with a variety of abrasive belts. Abrasive belts comprise abrasive particles secured to a backing with a suitable binder. In some embodiments, coated abrasive belts may comprise an array of shaped composites as described in U.S. Pat. No. 5,152,917 (Pieper et al.). In some embodiments the coated abrasive belts may comprise superabrasive particles such as diamond and cubic boron nitride. Such superabrasive belts are frequently used to finally-dimension and polish cylindrical surfaces to which has been applied a hard, wear-resistant coating such as, for example, metal oxides, such as aluminum oxide and zirconium oxide; carbides, such as titanium carbide, tungsten carbide, and chromium carbide; nitrides such as titanium nitride and silicon nitride; and hard metal coatings such as chrome-nickel-boron alloys. Such high value-added cylinders frequently require exact dimensioning and the application of a precise surface finish. By employing a composite contact wheel, the (translational) encounter of the superabrasive belt surface with the workpiece is precisely controllable due to the incompressibility of the contact wheel. Further, the vibration-damping properties of the composite contact wheel minimize deleterious waviness and other surface finish imperfections by helping to isolate machine- or process-induced vibrations.

The coated abrasive belt can be driven by the composite contact wheel by contact of the cylindrical peripheral surface of the composite contact wheel to the backside (non-abrasive side) of the superabrasive belt. In some embodiments, there are additional rolling or sliding surfaces over which the belt passes, thereby defining a convenient belt path to accommodate installation on any grinding machine.

An embodiment of this disclosure is a method of abrading a cylindrical workpiece comprising the steps of:

providing a grinding assembly comprising an abrasive belt supported by a composite contact wheel;

mounting the cylindrical workpiece proximate the grinding assembly;

moving the abrasive belt and rotating the cylindrical workpiece; and contacting the moving abrasive belt with the rotating cylindrical workpiece.

The methods of the present disclosure can be used with roll grinding and centerless grinding assemblies equipped to handle abrasive belts, as well as other grinding assemblies, including surface grinders equipped to handle abrasive belts.

Generally, a roll grinding machine will secure and rotate a cylindrical workpiece to systematically present its surface for modification. In operation, the cylindrical workpiece is rotated at about 23 meters per minute (75 sfpm), and the abrasive belt is driven at 1500-1900 meters per minute (5,000-6,000 sfpm). The abrasive belt is typically 5 centimeters wide and is typically traversed at 6.35 millimeters per revolution (0.25 inches/revolution) of the workpiece. The abrasive belt driven by the composite contact wheel is typically urged against the rotating workpiece at in increments as suitable for the material being ground. Such working parameters are identified in FIG. 4.

The composite contact wheel of the present disclosure can also be used for centerless grinding machines. Suitable centerless grinding machines, such as Acme (Auburn Hills, Mich.) machine centerless belt grinders or Cincinnati Machine or Landis Grinding Systems bonded wheel centerless that are readily converted to accept abrasive belts and their concomitant contact wheels. Generally, a centerless grinding machine will rotate and feed a cylindrical workpiece across a rotating abrasive to systematically present its surface for modification. In operation, the cylindrical workpiece is rotated at about 46 meters per minute (150 sfpm), and the abrasive belt is driven at 1500-1900 meters per minute (5,000-6,000 sfpm). The abrasive belt is typically 10-20 centimeters wide. The part through feed rate can be up to 20 meters per minute (60 fpm). The abrasive belt driven by the composite contact wheel is typically urged against the rotating workpiece to generate a motor amp draw of 10-25 percent over idle as suitable for the material being ground.

It is to be understood that even in the numerous characteristics and advantages of the present invention set forth in above description and examples, together with details of the structure and function of the invention, the disclosure is illustrative only. Changes can be made to detail, especially in matters of shape, size and arrangement of the contact wheel and methods of use within the principles of the invention to the full extent indicated by the meaning of the terms in which the appended claims are expressed and the equivalents of those structures and methods.

What is claimed is:

1. A composite contact wheel for supporting an abrasive belt, said composite contact wheel comprising a first side, a second side opposite said first side, and a cylindrical peripheral surface extending between said first side and said second side, wherein said composite contact wheel comprises a first composition comprising at least 10 percent by weight polymer and at least 20 percent by weight reinforcing fiber, and wherein said cylindrical peripheral surface has substantially uniform hardness of at least 50 Shore D.

2. The composite contact wheel of claim 1 wherein said polymer comprises phenol-formaldehyde.

3. The composite contact wheel of claim 1 wherein said reinforcing fiber comprises glass fibers.

4. The composite contact wheel of claim 1 wherein said cylindrical peripheral surface has a substantially uniform hardness of at least 70 Shore D.

5. The composite contact wheel of claim 1 comprising a substantially homogeneous composition.

6. The composite contact wheel of claim 1 further comprising an annular rim and a hub, wherein said annular rim comprises said cylindrical peripheral surface and said first composition, and said hub comprises a second composition.

7. The composite contact wheel of claim 6 wherein said polymer of said first composition comprises phenol-formaldehyde, and said reinforcing fiber comprises glass fibers.

8. The composite contact wheel of claim 6 wherein said annular rim comprises a substantially homogeneous composition.

9. The composite contact wheel of claim 1 further comprising a mounting hole extending from said first side to said second side.

10. The composite contact wheel of claim 1 further comprising an abrasive element affixed to at least said first side.

11. A composite contact wheel for supporting an abrasive belt, said composite contact wheel comprising a first side, a second side opposite said first side, and a cylindrical peripheral surface extending between said first side and said second side, wherein said composite contact wheel comprises at least 20 percent by weight phenol-formaldehyde and at least 20 percent by weight reinforcing fiber, and wherein said cylindrical peripheral surface has a substantially uniform hardness of at least 70 Shore D.

12. The composite contact wheel of claim 11 wherein said reinforcing fiber comprises glass fibers.

13. The composite contact wheel of claim 11 wherein said cylindrical peripheral surface has a substantially uniform hardness of at least 90 Shore D.

14. The composite contact wheel of claim 11 comprising a substantially homogeneous composition.

15. A grinding assembly comprising:

a composite contact wheel for supporting an abrasive belt comprising a first side, a second side opposite said first side, and a cylindrical peripheral surface extending between said first side and said second side, wherein said composite contact wheel comprises at least 10 percent by weight polymer and at least 20 percent by weight reinforcing fiber, and wherein said cylindrical peripheral surface has a substantially uniform hardness of at least 50 Shore D;

at least one idler wheel for supporting said abrasive belt; and a frame assembly that supports said composite contact wheel and said idler wheel.

16. The grinding assembly of claim 15 further comprising a coated abrasive belt.

17. The grinding assembly of claim 15 wherein said polymer comprises phenol-formaldehyde.

18. The grinding assembly of claim 15 wherein said reinforcing fiber comprises glass fibers.

19. The grinding assembly of claim 15 wherein said cylindrical peripheral surface has a substantially uniform hardness of at least 70 Shore D.

20. The grinding assembly of claim 15 wherein said cylindrical peripheral surface has a substantially uniform hardness of at least 90 Shore D.

21. The grinding assembly of claim 15 wherein said composite contact wheel comprises a substantially homogeneous composition.

22. A method of grinding a cylindrical workpiece comprising:

providing a grinding assembly comprising an abrasive belt supported by a composite contact wheel comprising a first side, a second side opposite said first side, and a cylindrical peripheral surface extending between said first side and said second side, wherein said composite contact wheel comprises at least 10 percent by weight polymer and at least 20 percent by weight reinforcing fiber, and wherein said cylindrical peripheral surface has a substantially uniform hardness of at least 50 Shore D;

mounting said cylindrical workpiece proximate said grinding assembly;

moving said abrasive belt and rotating said cylindrical workpiece; and contacting said moving abrasive belt with said rotating cylindrical workpiece.

23. The method of claim 22 wherein said grinding assembly is stationary and said cylindrical workpiece is moved to create contact with said abrasive belt.

24. The method of claim 22 wherein said composite contact wheel and said abrasive belt are moved relative to said cylindrical workpiece to create contact with said cylindrical workpiece.

25. The method of claim 22 wherein an abrasive element is affixed to at least said first side of said composite contact wheel, and said abrasive element contacts and abrades a planar surface of said cylindrical workpiece.

* * * * *